US011474460B2

(12) United States Patent
Ochiai

(10) Patent No.: US 11,474,460 B2
(45) Date of Patent: Oct. 18, 2022

(54) ELASTIC MEMBER, TRANSFER DEVICE, PROCESS CARTRIDGE, AND IMAGE FORMING APPARATUS

(71) Applicant: FUJIFILM Business Innovation Corp., Tokyo (JP)

(72) Inventor: Makoto Ochiai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/316,886

(22) Filed: May 11, 2021

(65) Prior Publication Data

US 2022/0197194 A1 Jun. 23, 2022

(30) Foreign Application Priority Data

Dec. 21, 2020 (JP) ..... JP2020-211789

(51) Int. Cl.
*G03G 15/16* (2006.01)
*G03G 21/18* (2006.01)

(52) U.S. Cl.
CPC ..... *G03G 15/1685* (2013.01); *G03G 21/1814* (2013.01)

(58) Field of Classification Search
CPC ..... G03G 15/1685; G03G 21/1814
See application file for complete search history.

(56) References Cited

U.S. PATENT DOCUMENTS

2010/0215412 A1* 8/2010 Chiba ..... G03G 15/6558 399/310
2016/0282768 A1* 9/2016 Bayer ..... G03G 15/1605

FOREIGN PATENT DOCUMENTS

JP 2003-195597 A 7/2003
JP 2003-215951 A 7/2003
JP 5108561 B2 12/2012

* cited by examiner

*Primary Examiner* — Hoang X Ngo
(74) *Attorney, Agent, or Firm* — Sughrue Mion, PLLC

(57) ABSTRACT

An elastic member includes a substrate, and a single-layer elastic layer provided on the substrate. An elastic modulus of the elastic layer at a distortion of 10% is 0.15 MPa or more. When in the elastic layer, a thickness from the surface on a side opposite to the substrate to the substrate-side surface is t, and when in the elastic layer, a region from the surface on the side opposite to the substrate to a position at a depth of t/2.125 is referred to as an "outer surface portion", and a region from the substrate-side surface to the position at a depth of t/2.125 is referred to as an "inner surface portion", a ratio (elastic modulus of outer surface portion/elastic modulus of inner surface portion) of an elastic modulus of the outer surface portion to an elastic modulus of the inner surface portion is 0.8 or less.

20 Claims, 3 Drawing Sheets

ELASTIC MEMBER, TRANSFER DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2020-211789 filed Dec. 21, 2020.

BACKGROUND

(i) Technical Field

The present disclosure relates to an elastic member, a transfer device, a process cartridge, and an image forming apparatus.

(ii) Related Art

Japanese Unexamined Patent Application Publication No. 2003-195597 proposes a conductive roller including a conductive elastic body formed on the outer peripheral surface of a shaft core, the electrical resistance of the conductive elastic body decreasing toward the outside from the shaft core.

Japanese Unexamined Patent Application Publication No. 2003-215951 proposes an image forming apparatus in which a toner image held on an image holding member is transferred to an information recording material. The toner image is transferred by applying an electric field from a roller, and a urethane sponge roller having an elastic layer formed by a urethane sponge layer is used as the roller, the urethane sponge layer having a configuration in which a layer near the roller shaft has a higher density than other layers.

Japanese Patent No. 5108561 proposes a developing roller including a conductive elastic layer formed of a foamed rubber formed by foaming a millable rubber material. In the conductive elastic layer, the foam cell density in a shaft-side portion is higher than the foam cell density in an outer peripheral surface-side portion, and foam cells having an average cell diameter of 70 to 300 μm are formed with a cell density of 55 to 85 cells/mm$^2$ in the shaft-side portion, while foam cells having an average cell diameter of 100 to 350 μm are formed with a cell density of 30 to 50 cells/mm$^2$ in the outer peripheral surface-side portion.

SUMMARY

Aspects of non-limiting embodiments of the present disclosure relate to an elastic member including a substrate and a single-layer elastic layer provided on the substrate. The elastic member can form a nearly uniform nip with a pressing target member, and distortion of the elastic layer possessed by the elastic member can be suppressed after the elastic member is maintained in a state of being pressed against the pressing target member, as compared with a case in which the elastic modulus of the elastic layer at a distortion of 10% is less than 0.15 MPa, the ratio (elastic modulus of outer surface portion/elastic modulus of inner surface portion) of the elastic modulus of an outer surface portion to the elastic modulus of an inner surface portion exceeds 0.8, or a difference (MD-1 hardness of inner surface portion—MD-1 hardness of outer surface portion) between the MD-1 hardness of an inner surface portion and the MD-1 hardness of an outer surface portion is less than 2° or exceeds 12°.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an elastic member including a substrate and a single-layer elastic layer provided on the substrate, wherein: an elastic modulus of the elastic layer at a distortion of 10% is 0.15 MPa or more; and when in the elastic layer, a thickness from the surface on a side opposite to the substrate to the substrate-side surface is t, and when in the elastic layer, a region from the surface on the side opposite to the substrate to a position at a depth of t/2.125 is referred to as an "outer surface portion", and a region from the substrate-side surface to the position at a depth of t/2.125 is referred to as an "inner surface portion", a ratio (elastic modulus of outer surface portion/elastic modulus of inner surface portion) of an elastic modulus of the outer surface portion to an elastic modulus of the inner surface portion is 0.8 or less.

BRIEF DESCRIPTION OF THE DRAWINGS

Exemplary embodiments of the present disclosure will be described in detail based on the following figures, wherein.

DETAILED DESCRIPTION

Figure 1:
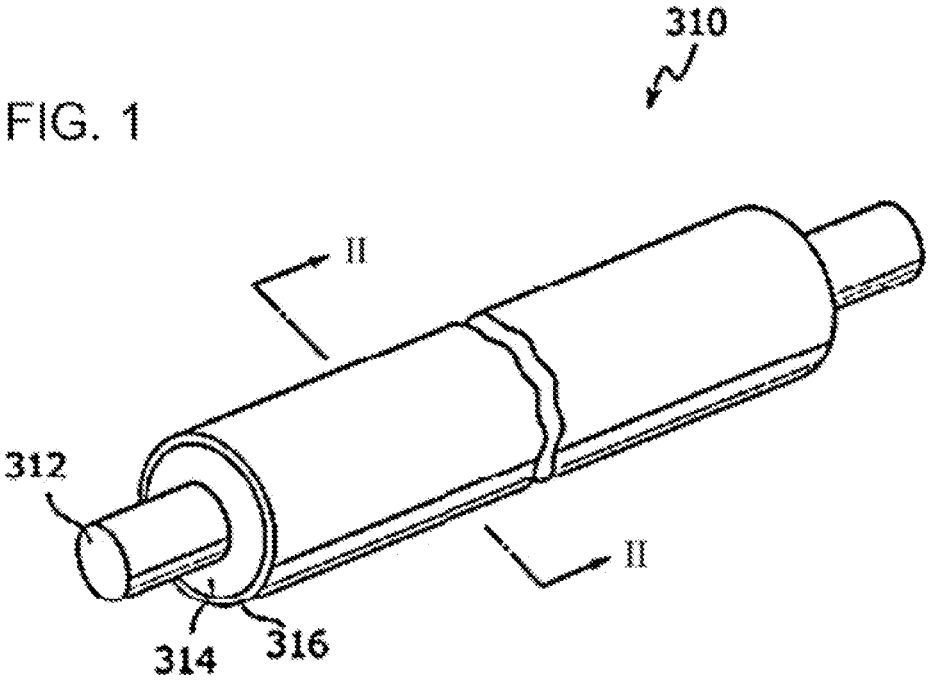
FIG. 1 is a schematic perspective view showing an example of an elastic member according to an exemplary embodiment of the present disclosure.

Exemplary embodiments of the present disclosure are described below. The description thereof and examples are illustrative of embodiments and do not limit the scope of the present disclosure.

In the present specification, the upper limit value or the lower limit value of one numeral range of the numeral ranges stepwisely described may be replaced by the upper limit value or the lower limit value of another numeral range stepwisely described. In addition, the upper limit value or the lower limit value of a numeral range described in the present specification may be replaced by a value described in examples.

Plural types of a material corresponding to each component may be contained.

In the description of the amount of each of the components in a composition, when plural types of a material corresponding to each of the components in the composition are present, the amount represents the total amount of the plural types of the material present in the composition unless otherwise specified.

<Elastic Member>

An elastic member according to a first exemplary embodiment of the present disclosure includes a substrate and a single-layer elastic layer provided on the substrate.

In addition, the elastic modulus of the elastic layer at a distortion of 10% is 0.15 MPa or more.

Further, the ratio (elastic modulus of outer surface portion/elastic modulus of inner surface portion) of the elastic modulus of the outer surface portion to the elastic modulus of the inner surface portion is 0.8 or less.

Herein, when in the elastic layer, the thickness from the surface on the side opposite to the substrate to the substrate-side surface is t (that is, when the thickness of the elastic layer is t), the inner surface portion 321 represents a region from the substrate-side surface of the elastic layer to the position at a depth of t/2.125.

Also, when in the elastic layer, the thickness from the surface on the side opposite to the substrate to the substrate-side surface is t, the outer surface portion 320 represents a region from the surface of the elastic layer on the side opposite to the substrate to the position at a depth of t/2.125.

An elastic member according to a second exemplary embodiment of the present disclosure has a substrate and a single-layer elastic layer provided on the substrate.

In addition, the elastic modulus of the elastic layer at a distortion of 10% is 0.15 MPa or more.

Further, when in the elastic layer, the thickness from the surface on the side opposite to the substrate to the substrate-side surface of the elastic layer is t, and when in the elastic layer, a region from the surface on the side opposite to the substrate to the position at a depth of t/2.125 is referred to as an "outer surface portion", and a region from the substrate-side surface of the elastic layer to the position at a depth of t/2.125 is referred to as an "inner surface portion", a difference (MD-1 hardness of inner surface portion—MD-1 hardness of outer surface portion) between the MD-1 hardness of the inner surface portion and the MD-1 hardness of the outer surface portion is 2° or more and 12° or less.

Hereinafter, the elastic member according to the first exemplary embodiment and the elastic member according to the second exemplary embodiment are also together referred to as the "elastic member according to the exemplary embodiment of the present disclosure".

In an image forming apparatus, an elastic member is used for a transfer member, a charging member, a recording medium transport member, etc. When the elastic member is used for these applications, for example, the elastic member is used in a state of being pressed against a pressing target member. When the image forming apparatus is in a stopped state, the elastic member may be maintained in a state of being pressed against the pressing target member. The elastic member used in the image forming apparatus is required to form a nearly uniform contact region (may be referred to as a "nip" hereinafter) between the elastic member and the pressing target member. Therefore, the elastic layer of the elastic member may have a low elastic modulus. Specifically, when the distortion of the elastic layer is 10%, the elastic modulus of the elastic layer is required to be 0.15 MPa or more. However, when such an elastic member is maintained in a state of being pressed against the pressing target member, the elastic layer of the elastic member may be easily deformed. Thus, when an image is formed after the elastic member is maintained in a state of being pressed against the pressing target member, the nip between the elastic member and the pressing target member easily becomes nonuniform, thereby easily causing problems such as an image defect and the like.

In the elastic member according to the first exemplary embodiment, the ratio (elastic modulus of outer surface portion/elastic modulus of inner surface portion) of the elastic modulus of the outer surface portion to the elastic modulus of the inner surface portion is 0.8 or less. This indicates a state where the elastic layer has a high elastic modulus in a region near the substrate and a low elastic modulus in a region near the outer surface portion (in other words, a region far from the substrate). The elastic modulus of the elastic layer is put in this state, and thus when the elastic member is pressed against the pressing target member, the elastic layer is deformed in the region near the outer surface portion, but is hardly deformed in the region near the substrate. Therefore, when the elastic member according to the first exemplary embodiment is pressed against the pressing target member, an easy deformable portion is limited to the region near the outer surface portion, thereby decreasing the distortion of the elastic layer. Thus, after the elastic member is maintained in a state of being pressed against the pressing target member, the distortion of the elastic layer possessed by the elastic member is suppressed. In addition, when the elastic modulus ratio (elastic modulus of outer surface portion/elastic modulus of inner surface portion) is 0.8 or less, after the elastic member is maintained in the state of being pressed against the pressing target member, the distortion of the elastic layer possessed by the elastic member is effectively suppressed.

From the above, the elastic member according to the first exemplary embodiment having the configuration described above is one which can form a nearly uniform nip with the pressing target member and which has suppressed distortion of the elastic layer possessed by the elastic member after the elastic member is maintained in the state of being pressed against the pressing target member.

In the elastic member according to the second exemplary embodiment, the difference (MD-1 hardness of inner surface portion—MD-1 hardness of outer surface portion) between the MD-1 hardness of the inner surface portion and the MD-1 hardness of the outer surface portion is 2° or more and 12° or less. This indicates a state where the elastic layer has high hardness in a region near the substrate and low hardness in a region near the outer surface portion (in other words, a region far from the substrate). The elastic layer has the MD-1 hardness in this state, and thus when the elastic member is pressed against the pressing target member, the elastic layer is deformed in the region near the outer surface portion, but is hardly deformed in the region near the substrate. Therefore, when the elastic member according to the second exemplary embodiment is pressed against the pressing target member, an easy deformable portion is limited to the region near the outer surface portion, thereby decreasing the distortion of the elastic layer. Thus, after the elastic member is maintained in the state of being pressed against the pressing target member, the distortion of the elastic layer possessed by the elastic member is suppressed. In addition, when the difference (MD-1 hardness of inner surface portion—MD-1 hardness of outer surface portion) between the MD-1 hardness of the inner surface portion and the MD-1 hardness of the outer surface portion is 2° or more and 12° or less, after the elastic member is maintained in the state of being pressed against the pressing target member, the distortion of the elastic layer possessed by the elastic member is effectively suppressed.

From the above, the elastic member according to the second exemplary embodiment having the configuration described above is one which can form a nearly uniform nip with the pressing target member, and which has suppressed distortion in the elastic layer possessed by the elastic member after the elastic member is maintained in the state of being pressed against the pressing target member.

The possibility to form a nearly uniform nip with the pressing target member and the suppression of distortion of the elastic layer can be realized by forming the elastic layer of a multilayer type in which a layer in the region near the substrate is a layer having a high elastic modulus or hardness and a layer in the region far from the substrate is a layer having a low elastic modulus or hardness. However, when like in the elastic member according to the exemplary embodiment of the present disclosure, the elastic layer is a single layer, the elastic modulus of the elastic layer at a distortion of 10% is 0.15 MPa or more, and the elastic modulus ratio (elastic modulus of outer surface portion/elastic modulus of inner surface portion) or the difference (MD-1 hardness of inner surface portion—MD-1 hardness of outer surface portion) between the MD-1 hardness of the inner surface portion and the MD-1 hardness of the outer surface portion is within the range described above, a more nearly uniform nip can be formed with the pressing target member, and the distortion of the elastic layer possessed by the elastic member can be more suppressed after the elastic member is maintained in the state of being pressed against the pressing target member, as compared with the multilayer elastic layer.

The reason for this is that in the single-layer type, when subjected to a load, partial deformation or stress concentration hardly occurs because the foam structure is continuously changed, while in the multilayer type, deformation or stress concentration easily occurs in a portion between layers having different hardness values. Thus, even when in the multilayer elastic layer, a high-elastic modulus or high-hardness layer as a layer in the region near the substrate and a low-elastic modulus or low-hardness layer as a layer in the region far from the substrate are formed by simply changing the foam structure or the hardness, the effect of suppressing the distortion is poor, and a nearly uniform nip is hardly formed, as compared with the single-layer elastic layer.

An elastic member corresponding to both the elastic members according to the first and second exemplary embodiments is described in detail below. However, the elastic member according to the exemplary embodiment of the present disclosure may be at least either of the elastic members according to the first exemplary embodiment and the second exemplary embodiment.

The elastic member according to the exemplary embodiment of the present disclosure is described with reference to the drawings.

Figure 2:
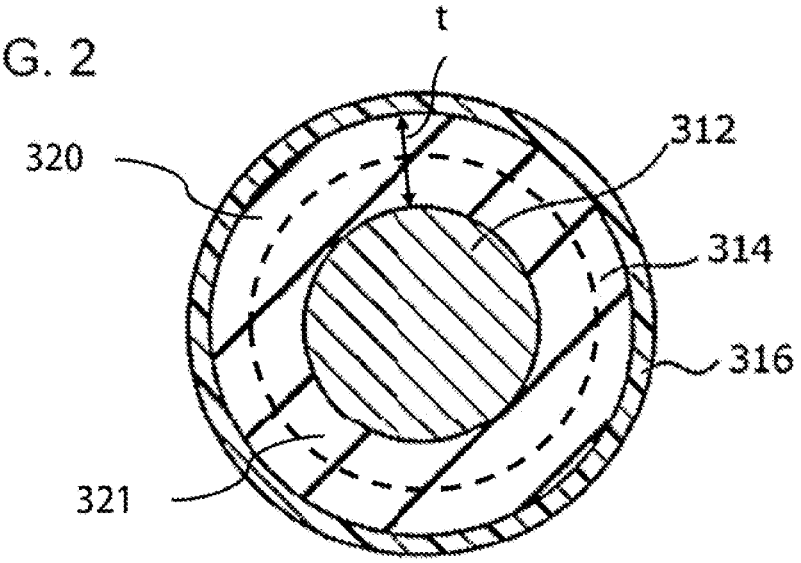
FIG. 2 is a schematic sectional view showing an example of an elastic member according to an exemplary embodiment of the present disclosure, which is a II-II sectional view of FIG. 1.

FIG. 1 is a schematic perspective view showing an example of the elastic member according to the exemplary embodiment of the present disclosure. FIG. 2 is a schematic sectional view showing an example of the elastic member according to the exemplary embodiment of the present disclosure. In addition, FIG. 2 is a II-II sectional view of FIG. 1.

As shown in FIG. 1 and FIG. 2, an elastic member 310 includes, for example, a cylindrical or columnar substrate 312, an elastic layer 314 disposed on the outer peripheral surface of the substrate 312, and a surface layer 316 formed by treating a surface layer of the elastic layer 314. The elastic layer including the inner surface portion 321 and the outer surface portion 320.

The elastic member 310 is not limited to the configuration described above and may have, for example, a configuration without the surface layer 316, that is, a configuration including the substrate 312 and the elastic layer 314.

Also, the elastic member 310 may have a configuration including an intermediate layer (for example, an adhesive layer) provided between the elastic layer 314 and the substrate 312 and a resistance control layer or a migration preventing layer provided between the elastic layer 314 and the surface layer 316.

The elastic member 310 according to the exemplary embodiment of the present disclosure is described in detail below. In the description below, reference numerals are omitted.

(Substrate)

The substrate is a member (for example, a shaft) functioning as a support member of the elastic member.

Examples of the material of the substrate include metals such as iron (for example, free-cutting steel or the like), copper, brass, stainless, aluminum, nickel, and the like. Examples of the substrate include a member (for example, a resin member or a ceramic member) having a plated outer surface, a member (for example, a resin member or a ceramic member) containing a conductive agent dispersed therein, and the like.

The substrate may be either a hollow member (for example, a cylindrical member) or a non-hollow member (for example, a columnar member).

(Elastic Layer)

The elastic layer is a single-layer elastic layer provided on the substrate.

The elastic layer preferably contains a rubber material.

Specifically, the elastic layer is configured by a vulcanized product of an unvulcanized rubber composition containing an unvulcanized rubber material and, if required, well-known additives such as a conductive agent, a vulcanization agent, a vulcanization accelerator, and the like.

The rubber material is a material including an elastomer. The unvulcanized rubber is, for example, a material having a carbon-carbon double bond at least in the chemical structure and being crosslinked by vulcanization reaction to produce a rubber material.

Examples of the rubber material include isoprene rubber, chloroprene rubber, epichlorohydrin rubber, butyl rubber, polyurethane, silicone rubber, fluorocarbon rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and the like, and mixed rubber thereof.

Among these, the rubber material is preferably polyurethane, EPDM, epichlorohydrin-ethylene oxide copolymer rubber, epichlorohydrin-ethylene oxide-allyl glycidyl ether copolymer rubber, NBR, or mixed rubber thereof, and is more preferably epichlorohydrin-ethylene oxide-ally glycidyl ether copolymer rubber (ternary epichlorohydrin rubber composed of a copolymer of epichlorohydrin, ethylene oxide, and allyl glycidyl ether).

These rubber materials may be used alone or in combination of two or more.

The elastic layer may be either a foamed elastic layer or a nonfoamed elastic layer, but is preferably a foamed elastic layer from the viewpoint of causing the elastic modulus and harness of the elastic layer to fall within respective desired ranges.

The elastic layer may contain a conductive agent. That is, the elastic layer may be a conductive elastic layer.

Examples of the conductive agent include an electron conductive agent and an ion conductive agent.

Examples of the electron conductive agent include powders of carbon black such as Ketjen black, acetylene black, and the like; pyrolytic carbon and graphite; various conductive metals or alloys such as aluminum, copper, nickel, stainless steel, and the like; various conductive metal oxides such as tin oxide, indium oxide, titanium oxide, tin oxide-antimony oxide solid solution, tin oxide-indium oxide solid solution, and the like; an insulating material with a surface subjected to conductive treatment; and the like.

Examples of the ion conductive agent include perchloric acid salts, chloric acid salts, and the like of tetraethylammonium, lauryl trimethyl ammonium, and the like; perchloric acid salts and chloric acid salts of alkali metals and alkaline-earth metals such as lithium, magnesium, and the like; and the like.

These conductive agents may be used alone or in combination of two or more.

The amount of the conductive agent added is not particularly limited, but in the case of the electron conductive agent, the amount relative to 100 parts by mass of the rubber material is preferably within a range of 1 part by mass or more and 30 parts by mass or less and more preferably within a range of 15 parts by mass or more and 25 parts by mass or less. While in the case of the ion conductive agent, the amount relative to 100 parts by mass of the rubber material is preferably within a range of 0.1 parts by mass or more and 5.0 parts by mass or less and more preferably within a range of 0.5 parts by mass or more and 3.0 parts by mass or less.

Examples of the additives other than the conductive agent include well-known additives such as a plasticizer, a vulcanization agent, a vulcanization accelerator, an antioxidant, a surfactant, a coupling agent, and the like.

(Characteristics of Elastic Layer)

—Elastic Modulus of Elastic Layer at Distortion of 10%—

The elastic modulus of the elastic layer at distortion of 10% is 0.15 MPa or less.

From the viewpoint of making it easy to form a more nearly uniform nip with the pressing target member, the elastic modulus of the elastic layer at s distortion of 10% is preferably 0.15 MPa or more and 0.5 MPa or less, more preferably 0.17 MPa or more and 0.4 MPa or less, and still more preferably 0.2 MPa or more and 0.35 MPa or less.

The elastic modulus of the elastic layer at s distortion of 10% is measured as follows.

First, a test piece is obtained from the elastic layer. A circular test piece having the dimensions including a diameter of 20 mm and the same thickness as the elastic layer is cut out. The obtained test piece is compressed in the thickness direction so that the distortion of the test piece is 10%. The test piece with a distortion of 10% is used for measuring stress according to the following procedures, and the elastic modulus of the elastic layer at a distortion of 10% is determined from the resultant measured values.

Measurement of Elastic Modulus

The stress is measured when compression distortion is changed at a constant rate (specifically, the test piece is further compressed in the thickness direction to increase the distortion of the test piece by 1 mm per minute) in an environment at a temperature of 22° C. and a humidity of 55% RH. The obtained results are analyzed by a data processing software, and the elastic modulus is calculated from a stress-distortion curve.

Elastic Modulus Ratio (Elastic Modulus of Outer Surface Portion/Elastic Modulus of Inner Surface Portion)

The ratio (elastic modulus of outer surface portion/elastic modulus of inner surface portion) of the elastic modulus of the outer surface portion to the elastic modulus of the inner surface portion of the elastic layer is 0.8 or less.

From the viewpoint of more suppressing distortion of the elastic layer possessed by the elastic member after the elastic member is maintained after being pressed against the pressing target member, the ratio (elastic modulus of outer surface portion/elastic modulus of inner surface portion) of the elastic modulus of the outer surface portion to the elastic modulus of the inner surface portion is preferably 0.2 or more and 0.8 or less, more preferably 0.4 or more and 0.7 or less, and still more preferably 0.5 or more and 0.6 or less.

From the viewpoint of making it possible to form a nearly uniform nip with the pressing target member, the elastic modulus of the outer surface portion is preferably 0.10 MPa or more and 0.30 MPa or less, more preferably 0.13 MPa or more and 0.27 MPa or less, and still more preferably 0.15 MPa or more and 0.25 MPa or less.

The procedures for measurement of the elastic modulus of the outer surface portion and the elastic modulus of the inner surface portion are as follows.

First, a test piece is obtained from the elastic layer. The test piece is cut in the dimensions of 10 mm in length, 10 mm in width and the same thickness as the elastic layer. The elastic modulus is measured at a total of 5 points in a cut surface of the obtained test piece while changing the measurement point at the center of the outer surface portion in the thickness direction. The arithmetic average of the obtained elastic modulus values is determined as the "elastic modulus of the outer surface portion". In addition, the elastic modulus is measured at a total of 5 points in a cut surface of the obtained test piece while changing the measurement point at the center of the inner surface portion in the thickness direction. The arithmetic average of the obtained elastic modulus values is determined as the "elastic modulus of the inner surface portion". The procedures for measurement of the elastic modulus are as follows.

Procedures for Measurement of Elastic Modulus

The stress is measured when compression distortion is changed at a constant rate (specifically, the test piece is compressed in the thickness direction by pressing the test pieces to increase the distortion of the test piece by 1 mm per minute) in an environment at a temperature of 22° C. and a humidity of 55% RH. The obtained results are analyzed by a data processing software, and the elastic modulus is calculated from a stress-distortion curve.

—MD-1 Hardness Difference (MD-1 Hardness of Inner Surface Portion—MD-1 Hardness of Outer Surface Portion)—

A difference (MD-1 hardness of inner surface portion—MD-1 hardness of outer surface portion) between the MD-1 hardness of the inner surface portion and the MD-1 hardness of the outer surface portion of the elastic layer is 2° or more and 12° or less.

From the viewpoint of more suppressing the distortion of the elastic layer possessed by the elastic member after the elastic member is maintained after being pressed against the pressing target member, a difference (MD-1 hardness of inner surface portion—MD-1 hardness of outer surface portion) between the MD-1 hardness of the inner surface portion and the MD-1 hardness of the outer surface portion of the elastic layer is preferably 4° or more and 10° or less, more preferably 5° or more and 9° or less, still more preferably 6° or more and 8° or less.

In the elastic layer of the elastic member according to the first exemplary embodiment, a difference (MD-1 hardness of inner surface portion—MD-1 hardness of outer surface portion) between the MD-1 hardness of the inner surface portion and the MD-1 hardness of the outer surface portion is preferably 2° or more and 12° or less, more preferably 4° or more and 10° or less, still more preferably 5° or more and 9° or less.

When in the elastic layer of the elastic member according to the first exemplary embodiment, the difference (MD-1 hardness of inner surface portion—MD-1 hardness of outer surface portion) between the MD-1 hardness of the inner surface portion and the MD-1 hardness of the outer surface portion is within the range described above, the distortion of the elastic layer possessed by the elastic member can be more easily suppressed after the elastic member is maintained after being pressed against the pressing target member. The reason for this is supposed as follows.

The elastic layer of the elastic member according to the first exemplary embodiment has the effect of suppressing the distortion of the elastic layer because the ratio (elastic modulus of outer surface portion/elastic modulus of inner surface portion) of the elastic modulus of the outer surface portion to the elastic modulus of the inner surface portion is 0.8 or less. In addition, the elastic layer of the elastic member according to the first exemplary embodiment becomes an elastic layer provided with a resistance to the force applied from the outside because the difference (MD-1 hardness of inner surface portion—MD-1 hardness of outer surface portion) between the MD-1 hardness of the inner surface portion and the MD-1 hardness of the outer surface portion of the elastic layer is within the range described above. The distortion suppressing effect derived from the elastic modulus is combined with the force resistance derived from the MD-1 hardness, thereby more easily suppressing the distortion of the elastic layer possessed by the elastic member after the elastic member is maintained after being pressed against the pressing target member.

From the viewpoint of making it possible to form a nearly uniform nip with the pressing target member, the MD-1 hardness of the outer surface portion is preferably 9° or more and 21° or less, more preferably 11° or more and 19° or less, and still more preferably 14° or more and 17° or less.

The procedures for measurement of the MD-1 hardness are as follows.

First, a test piece is obtained from the elastic layer. The test piece is cut in the dimensions of 10 mm in length, 10 mm in width and the same thickness as the elastic layer. The MD-1 hardness is measured at a total of 10 points in a cut surface of the obtained test piece while changing the measurement point at the center of the outer surface portion in the thickness direction. The arithmetic average of the obtained MD-1 hardness values is determined as the "MD-1 hardness of the outer surface portion". In addition, the elastic modulus is measured at a total of 10 points in a cut surface of the obtained test piece while changing the measurement point at the center of the inner surface portion in the thickness direction. The arithmetic average of the obtained MD-1 hardness values is determined as the "MD-1 hardness of the inner surface portion". The conditions of measurement of the MD-1 hardness are as follows.

Measurement apparatus: MD-1 capa type-A manufactured by Kobunshi Keiki Co., Ltd.

Measurement conditions: normal measurement mode, 2-second value timer

—Specific Gravity of Elastic Layer—

The specific gravity of the elastic layer is preferably 0.3 g/cm$^3$ or more and 0.8 g/cm$^3$ or less, more preferably 0.35 g/cm$^3$ or more and 0.75 g/cm$^3$ or less, and still more preferably 0.4 g/cm$^3$ or more and 0.7 g/cm$^3$ or less.

When the elastic layer of the elastic member according to the exemplary embodiment of the present disclosure has a specific gravity within the range described above, the elastic member can be allowed to form a more nearly uniform nip with the pressing target member and to more suppress the distortion of the elastic layer possessed by the elastic member after the elastic member is maintained after being pressed against the pressing target member. The reason for this is as follows.

When the specific gravity of the elastic layer is 0.8 g/cm$^3$ or less, the content of the rubber material in the elastic layer is not excessively large, and the load at the time of deformation of the elastic layer does not easily become large. Therefore, a more nearly uniform nip can be easily formed. When the specific gravity of the elastic layer is 0.3 g/cm$^3$ or more, the content of the rubber material in the elastic layer is not excessively small, and the structure is easily maintained when the elastic layer is subjected to a load, thereby more easily suppressing the distortion of the elastic layer.

The specific gravity of the elastic layer is measured according to JIS K 7222 (2005).

The Asker C hardness of the elastic layer, measured from the surface of the elastic layer on the side opposite to the substrate, is preferably 25° or more and 45° or less, more preferably 28° or more and 40° or less, and still more preferably 30° or more and 38° or less.

When the elastic layer of the elastic member according to the exemplary embodiment of the present disclosure has an Asker C hardness within the range described above, a more nearly uniform nip can be formed with the pressing target member.

The Asker C hardness is measured by pressing a measurement needle of an Asker C-type durometer (manufactured by Kobunshi Keiki Co., Ltd.) on the surface of the elastic layer on the side opposite to the substrate according to JIS K 7312: 1996.

—Other Characteristics—

The volume resistivity of the elastic layer may be $10^3$ Ωcm or more and $10^{15}$ Ωcm or less, is preferably $10^5$ Ωcm or more and $10^{14}$ Ωcm or less, and more preferably $10^6$ Ωcm or more and $10^{13}$ Ωcm or less.

The volume resistivity of the elastic layer is a value measured by a method described below.

A sheet-like measurement sample is obtained from the elastic layer, and a voltage adjusted so as to produce an electric field (applied voltage/composition sheet thickness) of 1000 V/cm is applied to the measurement sample for 30 seconds by using a measurement jig (R12702A/B resistivity chamber: manufactured by Advantest Corporation) and a high-resistance meter (R8340A digital high-resistance/microcurrent meter: manufactured by Advantest Corporation) according to JIS K 6911 (1995). Then, the volume resistivity is calculated from the flowing current value according to the following formula.

Volume resistivity (Ωcm)=(19.63×applied voltage (V)/(current value (A)×measurement sample thickness (cm))

From the viewpoint of making it possible to form a nearly uniform nip with the pressing target member and more suppressing the distortion of the elastic layer possessed by the elastic member after the elastic member is maintained in the state of being pressed against the pressing target member, the thickness of the elastic layer may be 2 mm or more and 15 mm or less and is preferably 4 mm or more and 10 mm or less.

The thickness of the elastic layer is a value measured by a method described below.

The elastic layer is cut at the three positions, positions of 20 mm from both ends and a central position of the elastic member in the axial direction, by using a single-edged knife, and the thickness is measured by observing a section of each of the cut-out samples at a proper magnification of 5 to 50 times according to the thickness. The measured values are averaged. The measurement apparatus used is digital microscope VHX-200 manufactured by Keyence Corporation.

(Surface Layer)

If required, the elastic member may have a surface layer.

The surface layer may have a configuration in which a resin layer or the like is independently provided on the elastic layer or a configuration in which the bubbles in a surface layer portion of a foamed elastic layer are impregnated with a resin or the like (that is, a configuration in which a surface layer portion of an elastic layer containing bubbles impregnated with a resin or the like serves as a surface layer).

The material for forming the surface layer is, for example, a resin.

Examples of the resin include an acrylic resin, a fluorine-modified acrylic resin, a silicone-modified acrylic resin, a cellulose resin, a polyamide resin, a copolymerized nylon, a polyurethane resin, a polycarbonate resin, a polyester resin, a polyimide resin, an epoxy resin, a silicone resin, a polyvinyl alcohol resin, a polyvinyl butyral resin, a cellulose resin, a polyvinyl acetal resin, an ethylene tetrafluoroethylene resin, a melamine resin, a polyethylene resin, a polyvinyl resin, a polyarylate resin, a polythiophene resin, a polyethylene terephthalate resin (PET), and fluorocarbon resins (polyvinylidene fluoride resin, a tetrafluoroethylene resin, tetrafluoroethylene-perfluoroalkyl vinyl ether copolymer (PFA), tetrafluoroethylene-hexafluoropropylene copolymer (FEP), and the like). In addition, the resin is preferably produced by curing or crosslinking a curable resin with a curing agent or a catalyst.

The copolymerized nylon is a copolymer containing, as a polymerization unit, any one or plural of 610 nylon, 11 nylon, 12 nylon. The copolymerized nylon may contain another polymerization unit such as 6 nylon, 66 nylon, or the like.

Among these, from the viewpoint of preventing stain, the resin is preferably a polyvinylidene fluoride resin, a tetrafluoroethylene resin, or a polyamide resin, and from the viewpoint of abrasion resistance of the surface layer and of suppressing separation of porous resin particles, the resin is more preferably a polyamide resin.

In particular, from the viewpoint of abrasion resistance of the surface layer, the polyamide resin is preferably alkoxymethylated polyamide (alkoxymethylated nylon), and more preferably methoxymethylated polyamide (N-methoxymethylated nylon).

In addition, the resin may have a crosslinked structure in view of improving the mechanical strength of the surface layer and of suppressing the occurrence of crack in the surface layer.

Examples of other materials for forming the surface layer include well-known additives which can be generally added to a surface layer include a conductive agent, a filler, a curing agent, a vulcanization agent, a vulcanization accelerator, an antioxidant, a surfactant, a coupling agent, and the like.

The thickness of the surface layer may be, for example, 2 μm or more and 25 μm or less, and is preferably 3 μm or more and 20 μm or less, more preferably 3 μm or more and 15 μm or less, and still more preferably 5 μm or more and 15 μm or less.

The thickness of the surface layer is a value measured by a method described below. The elastic layer is cut at three positions, portions of 20 mm from both ends and a central position of the elastic member in the axial direction, by using a single-edged knife, and the thickness is measured by observing a section of each of the cut-out samples at a magnification of 1000 times. The measured values are averaged. The measurement apparatus used is digital microscope VHX-200 manufactured by Keyence Corporation.

<Application>

The elastic member according to the exemplary embodiment of the present disclosure is used for members for an electrophotographic image forming apparatus (a charging member which charges an image holding member, a transfer member which transfers a toner image to a recording medium or an intermediate transfer body, a recording medium transport member, an intermediate transfer body, etc.). Besides the members for an electrophotographic image forming apparatus, the elastic member may be also used for members (a charging member which charges a body to be charged, a transfer member which transfers a transferred material to a transfer target, etc.).

<Method for Producing Elastic Member>

An example of a method for producing the elastic member according to the exemplary embodiment of the present disclosure is described.

A method for producing the elastic member according to the exemplary embodiment of the present disclosure includes, for example, a process (also referred to as a "first process" hereinafter) of forming a layer of an nonvulcanized rubber composition after kneading on the substrate, and a process (also referred to as a "second process" hereinafter) vulcanizing the layer of the nonvulcanized rubber composition to form the elastic layer composed of the vulcanized product of the nonvulcanized rubber composition layer on the core.

The nonvulcanized rubber composition preferably contains a foaming agent. Also, the core is preferably a nonhollow core.

When the elastic member is produced by using the nonvulcanized rubber composition containing a foaming agent, the elastic layer of the elastic member is composed of a foam. The use of the nonhollow core easily causes a state where, in the second process, heat is easily added to a portion near the outer surface portion of the elastic layer, while heat is hardly added to a portion near the inner surface portion of the elastic layer. Therefore, a large amount of bubbles derived from the foaming agent easily occurs near the outer surface portion of the elastic layer. On the other hand, the amount of bubbles derived from the foaming agent near the inner surface portion of the elastic layer is easily put into a state of being less than that near the outer surface portion. That is, the resultant elastic layer contains many pores near the outer surface portion, while the pores contained near the inner surface portion easily become few. This difference in pore distribution easily causes distributions of elastic modulus and hardness in the elastic layer.

From the above, when the elastic member is produced by using the nonvulcanized rubber composition containing the foaming agent and using the nonhollow core as the core, the elastic layer is easily made having a ratio (elastic modulus of outer surface portion/elastic modulus of inner surface portion) of 0.8 or less of the elastic modulus of the outer surface portion to the elastic modulus of the inner surface portion or the elastic layer is easily made having a difference (MD-1 hardness of inner surface portion—MD-1 hardness of outer surface portion) of 2° or more and 12° or less between the MD-1 hardness of the inner surface portion and the MD-1 hardness of the outer surface portion.

Each of the processes is described in detail below.

—First Process—

In the first process, a layer of the nonvulcanized rubber composition (simply referred to as the "rubber material" hereinafter) is formed on the core. Specifically, a cylindrical rubber material layer (also referred to as a "rubber roll part" hereinafter) is formed on the outer peripheral surface of the core by, for example, using an extrusion molding machine 21 shown in FIG. 3.

The nonvulcanized rubber composition preferably contains the foaming agent.

A known foaming agent can be used, and either a chemical foaming agent or a physical foaming agent may be used, but a chemical foaming agent is preferred from the viewpoint of handleability and storage properties.

The chemical foaming agent may be either an inorganic compound or an organic compound, and a combination of two or more compounds may be used.

Examples of the organic chemical foaming agent include nitrosamine compounds such as dinitrosopentamethylene tetramine (DPT) and the like, azo compounds such as azodicarbonamide (ADCA) and the like, hydrazine compounds such as 4,4'-oxybisbenzene sulfonyl hydrazide (OBSH), hydrazodicarbonamide (HDCA), and the like.

Examples of the inorganic chemical foaming agent include hydrogen carbonate salts such as sodium bicarbonate and the like, carbonate salts, a combination of hydrogen carbonate salt and an organic acid salt, and the like.

Among these, the organic chemical foaming agent is preferred, and a nitrosamine compound, an azo compound, and a hydrazine compound are more preferred. In particular, at least one compound selected from the group consisting of azodicarbonamide (ADCA), 4,4'-oxybisbenzene sulfonyl hydrazide (OBSH), and dinitrosopentamethylene tetramine (DPT) is preferred.

Examples of the physical foaming agent include inert gas such as nitrogen, carbon dioxide, and the like, a volatile organic compound, and the like. Among these, inert gas is preferably used, and supercritical carbon dioxide or nitrogen, or a mixture thereof is preferably used.

These foaming agents may be used alone or in combination of two or more, and a combination of the chemical foaming agent and the physical foaming agent may be used.

The amount of the foaming agent used can be properly adjusted according to the characteristics of the resin used and application of the foam, but the amount relative to 100 parts by mass of the nonvulcanized rubber composition is preferably 0.1 parts by mass to 30 parts by mass, more preferably 0.5 parts by mass to 20 parts by mass, still more preferably 1 part by mass to 15 parts by mass, and particularly preferably 2 parts by mass to 10 parts by mass.

In order to form the rubber roll part on the outer peripheral surface of the core, an extrusion molding machine is preferably used. An example of the extrusion molding machine is described below.

Extrusion Molding Machine

Figure 3:
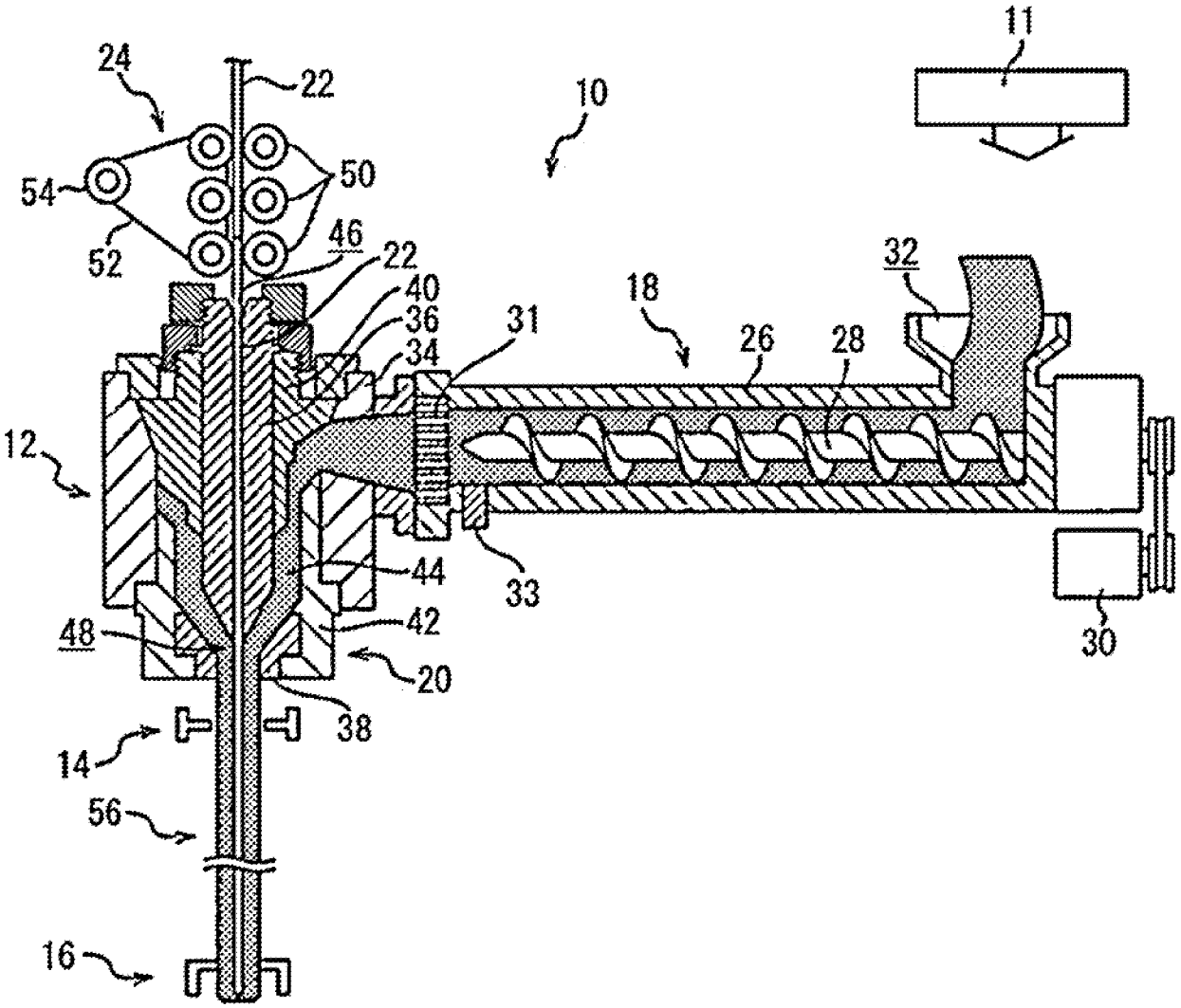
FIG. 3 is a schematic view showing an example of a configuration of an extrusion molding machine provided with a crosshead.

An extrusion molding machine 10 shown in FIG. 3 includes a discharger 12 configured by a so-called crosshead die, a pressurizer 14 disposed on the downstream side of the discharger 12, and a drawing-out machine 16 disposed on the downstream side of the pressurizer 14.

In addition, the extrusion molding machine 10 is provided with a controller 11 for controlling each of the parts in the apparatus.

The discharger 12 includes a rubber material supply part 18 which supplies the rubber material, an extrusion part 20 which cylindrically extrudes the rubber material supplied from the rubber material supply part 18, and a core supply part 24 which supplies the core 22 in a central portion of the rubber material cylindrically extruded from the extrusion part 20.

The rubber material supply part 18 has a screw 28 inside a cylindrical body part 26. The screw 28 is rotationally driven by a drive motor 30. The body part 26 has an inlet port 32 through which the rubber material is added and which is provided on the drive motor 30 side thereof. Further, a breaker plate 31 is provided at the rubber material extrusion port of the cylindrical body part 26. The rubber material added from the inlet port 32 is passed through the breaker plate 31 while being kneaded by the screw 28 in the body part 26, and then fed to the extrusion part 20.

The extrusion part 20 includes a cylindrical case 34 connected to the rubber supply part 18, a columnar mandrel 36 disposed at the center in the case 34, and a discharge head 38 disposed below the mandrel 36. The mandrel 36 is held by the case 34 by a holding member 40. The discharge head 38 is held by the case 34 by a holding member 42. In addition, an annular flow passage 44, through which the rubber material annularly flows, is formed between the outer peripheral surface of the mandrel 36 (in a portion, the outer peripheral surface of the holding member 40) and the inner peripheral surface of the holding member 42 (in a portion, the inner peripheral surface of the discharge head 38).

A through hole 46 is formed at the center of the mandrel 36 so that the core 22 is passed therethrough. A lower portion of the mandrel 36 has a shape tapered toward the end thereof. In addition, a lower region at the end of the mandrel 36 serves as a confluent region 48 where the core 22 suppled from the through hole 46 is joined to the rubber material supplied from the annular flow passage 44. That is, this shows a configuration in which the rubber material is cylindrically extruded to the confluent region 48, and the core 22 is fed to the central portion of the rubber material cylindrically extruded.

The core supply part 24 is provided with roll pairs 50 disposed above the mandrel 36. Plural (three) roll pairs 50 are provided so that the rolls on one of the sides of the roll pairs 50 are connected to the drive roll 54 through a belt 52. When the drive roll 54 is driven, the core 22 held between each of the roll pairs 50 is fed to the through hole 46 of the mandrel 36. This shows a configuration in which the core 22 has a predetermined length, and the rear core 22 fed by the roll pairs 50 pushes the front core 22 present in the through hole 46 of the mandrel 36, thereby sequentially passing plural cores 22 through the though hole 46. In addition, the drive of the drive roll 54 is temporally stopped when the front end of the front core 22 is located at the end of the mandrel 36, and the cores 22 are fed at intervals to the confluent region 48 below the mandrel 36.

Thus, in the discharger 12, the rubber material is cylindrically extruded in the confluent region 48, and the cores 22 are sequentially fed at intervals in the central portion of the rubber material. Therefore, the outer peripheral surface of the core 22 is coated with the rubber material, and the rubber roll portion 56 (cylindrical rubber material layer) is formed on the outer peripheral surface of the core 22. In addition, an adhesive layer (that is, a primer or an adhesive) may be previously coated on the outer peripheral surface of the core 22 in order to enhance the adhesion to the rubber material.

The controller 11 is configured so as to control the operation of each of the parts of the extrusion molding machine 10.

Specifically, although not shown in the drawings, the controller 11 is configured as, for example, a computer with a configuration in which CPU (Central Processing Unit), various memories (for example, RAM (Random Access Memory), ROM (Read Only Memory), and nonvolatile memory), and an input/output interface (I/O) are connected to each other through a bus. For example, the parts of the extrusion molding machine 10, such as a drive motor 30 which rotationally drives the screw 28, a drive motor (not shown) which rotationally drives the drive roller 54, a pressure gauge 33, etc., are connected to the I/O.

The CPU controls the operation of each of the parts of the extrusion molding machine 10 by executing a program (for example, a control program such as an extrusion molding program) stored in each of the memories. The storage media for storing the programs to be executed by the CPU are not limited to the memories. For example, a flexible disk, a DVD disk, a photomagnetic disk, a USB memory (universal serial bus memory), and the like (not shown) may be used, and a storage device of another apparatus connected to a communication unit (not shown) may be used.

—Second Process—

In the second process, the layer of the rubber material (nonvulcanized rubber composition) is vulcanized to form the elastic layer composed of the vulcanized product of the nonvulcanized rubber composition on the core (substrate).

In addition, when the nonvulcanized rubber composition contains the foaming agent, bubbles derived from the foaming agent are produced by the heat applied in this process.

Specifically, the layer of the rubber material (nonvulcanized rubber composition) is heated to the vulcanization temperature of the nonvulcanized rubber material. The layer of the rubber material is heated by, for example, using a heating furnace (such as a hot-wind heating furnace or the like). For example, the rubber roll having the rubber material layer formed on the outer peripheral surface of the core is heated at a heating temperature of 150° C. or more and 200° C. or less for a heating time of 10 minutes or more and 120 minutes or less. This causes vulcanization of the nonvulcanized rubber material contained in the rubber material layer to form the elastic layer.

Then, if required, the surface layer is formed on the surface of the elastic layer of the resultant rubber roll.

In this case, the core used for forming the elastic layer may be used as the substrate of the elastic member. In addition, the core may be removed from the rubber roll after forming the elastic layer, and the substrate may be inserted into a through hole of a cylindrical material composed of the elastic layer.

The elastic member according to the exemplary embodiment of the present disclosure is formed through the processes described above.

<Image Forming Apparatus/Transfer Device/Process Cartridge>

An image forming apparatus according to an exemplary embodiment of the present disclosure includes an image holding member, a charging device which charges the surface of the image holding member, an electrostatic latent image forming device which forms an electrostatic latent image on the charged surface of the image holding member, a developing device which forms a toner image by developing the electrostatic latent image formed on the surface of the image holding member with a developer containing a toner, and a transfer device which transfers the toner image to the surface of a recording medium.

In addition, a transfer device (transfer device according to an exemplary embodiment of the present disclosure) applied as the transfer derive includes the elastic member according to the exemplary embodiment of the present disclosure as a transfer member which transfers a toner image (an example of a transferred material) on the recording medium (an example of a transfer target).

On the other hand, a process cartridge according to an exemplary embodiment of the present disclosure is, for example, detachable from an image forming apparatus having the configuration described above and includes at least one of a charging device which charges the surface of an image holding member and a transfer derive which transfers a toner image to the surface of a recording medium. The transfer device according to the exemplary embodiment of the present disclosure is applied as the transfer device.

If required, the process cartridge according to the exemplary embodiment of the present disclosure may also include at least one selected from the group consisting of an image holding member, an electrostatic latent image forming device which forms an electrostatic latent image on the charged surface of the image holding member, a developing device which forms a toner image by developing the latent image formed on the surface of the image holding member with a toner, and a cleaning device which cleans the surface of the image holding member.

Next, the image forming apparatus and process cartridge according to the exemplary embodiments of the present disclosure are described with reference to the drawings.

Figure 4:
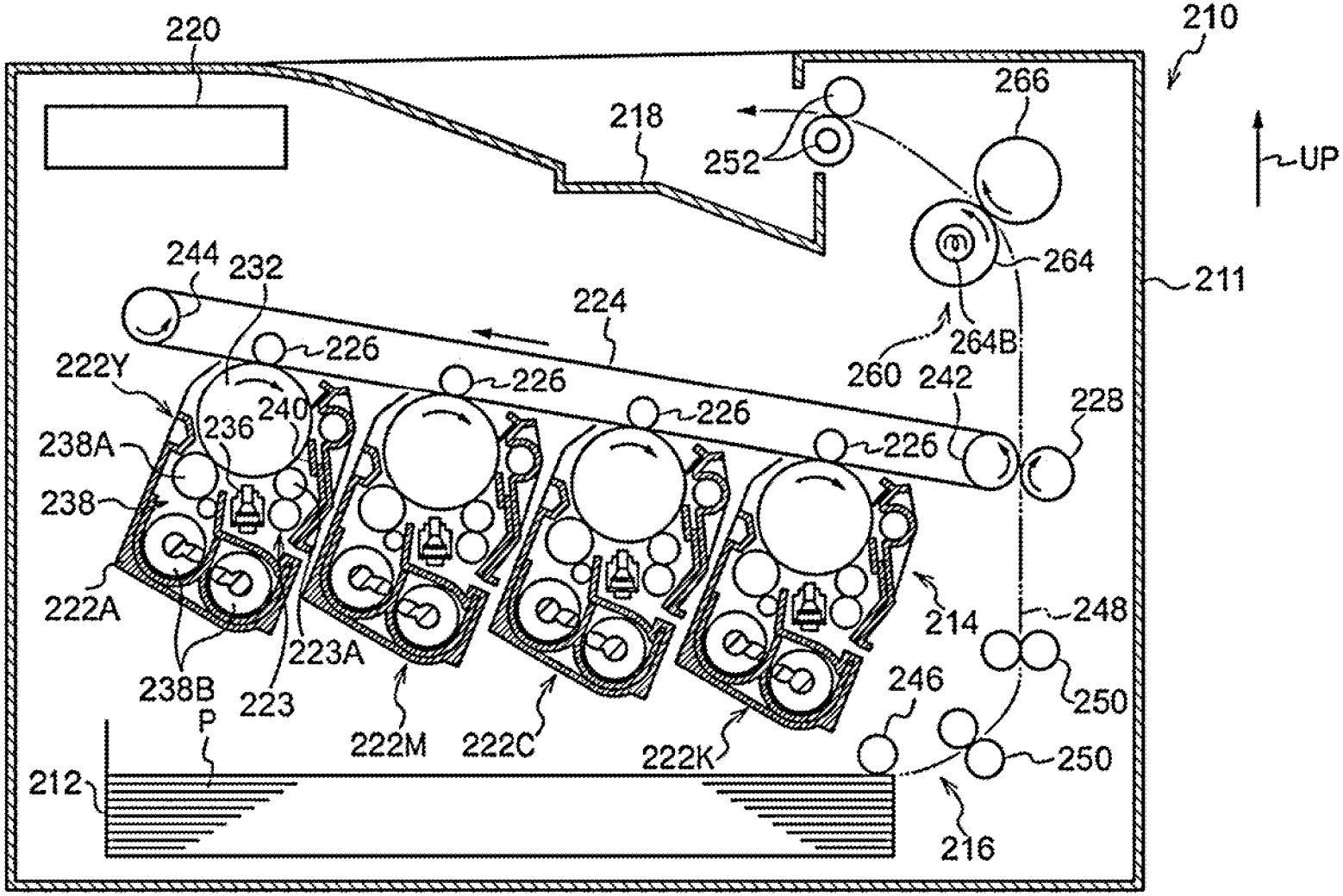
FIG. 4 is a schematic configuration diagram showing an example of an image forming apparatus according to an exemplary embodiment of the present disclosure.

FIG. 4 is a schematic configuration diagram showing the image forming apparatus according to the exemplary embodiment of the present disclosure. In addition, an arrow UP represents the upper side in the vertical direction.

As shown in FIG. 4, an image forming apparatus 210 includes an image forming apparatus body 211 which houses the constituent components therein. Provided, in the image forming apparatus body 211, are a housing part 212 which houses a recording medium P, such as paper or the like, an image forming part 214 which forms an image on the recording medium P, a transporting part 216 which transports the recording medium P from the housing part 212 to the image forming part 214, and a controller 220 which controls the operation of each of the parts of the image forming apparatus 210. Also, a discharge part 218, in which the recording medium P with an image formed thereon by the image forming part 214 is discharged, is provided in an upper portion of the image forming apparatus body 211.

The image forming part 214 includes image forming units 222Y, 222M, 222C, and 222K (referred to as "222Y to 222K" hereinafter) which form toner images of colors of yellow (Y), magenta (M), cyan (C), and black, (K), respectively, an intermediate transfer belt 224 (an example of the transfer target) to which the toner images formed in the image forming units 222Y to 222K are transferred, a first transfer roller 226 (an example of the transfer roller) which transfers the toner image formed in each of the image forming units 222Y to 222K to the intermediate transfer belt 224, and a second transfer roller 228 (an example of the transfer member) which transfers, to the recording medium P from the intermediate transfer belt 224, the toner images transferred to the intermediate transfer belt 224 by the first transfer rollers 226. The image forming part 214 is not limited to the configuration described above and may be another configuration as long as an image is formed on the recording medium P (an example of the transferred material).

Herein, a unit including the intermediate transfer belt 224, the first transfer rollers 226, and the second transfer roller 228 corresponds to an example of the transfer device. This unit may be formed as a cartridge (process cartridge).

The image forming units 222Y to 222K are arranged in an inclined state with the horizontal direction at a central portion in the vertical direction of the image forming apparatus 210. Also, each of the image forming units 222Y to 222K has a photoreceptor 232 (an example of the image holding member) which is rotated in a direction (for example, the clockwise direction in FIG. 4). In addition, the image forming units 222Y to 222K have the same configuration, and thus in FIG. 4, the reference numerals of the parts of the image forming units 222M, 222C, and 222K are omitted.

Around each of the photoreceptors 232, there are provided in order from the upstream side in the rotational direction of the photoreceptor 232, a charging device 223 having a charging roller 223A (an example of the charging member) which charges the photoreceptor 232, an exposure device 236 (an example of the electrostatic latent image forming device) which forms an electrostatic latent image on the photoreceptor 232 by exposing the photoreceptor 232 charged by the charging device 223, a developing device 238 which forms a toner image by developing the latent image formed on the photoreceptor 232 by the exposure derive 236, and a removing member (a cleaning blade or the like) 240 which is in contact with the photoreceptor 232 and removes the toner remaining on the photoreceptor 232.

Herein, the photoreceptor 232, the charging device 223, the exposure device 236, the developing device 238, and the removing member 240 are integrally held by a housing (casing) 222A to form a cartridge (process cartridge).

A self-scanning type LED print head is applied to the exposure device 236. The exposure device 236 may be an optical-system exposure device in which the photoreceptor 232 is exposed from a light source through a polygon mirror.

The exposure device 236 is adapted to form a latent image based on the image signal sent from the controller 220. The image signal sent from the controller 220 is, for example, an image signal acquired by the controller 220 from an external device.

The developing device 238 includes a developer supply body 238A which supplies a developer to the photoreceptor 232 and plural transport members 238B which transport the developer supplied to the developer supply body 238A while stirring the developer.

The intermediate transfer belt 224 is formed in an annular shape and is disposed above the image forming units 222Y to 222K. In addition, winding rollers 242 and 244, on which the intermediate transfer belt 224 is wound, are provided on the inner peripheral side of the intermediate transfer belt 224. When any one of the winding rollers 242 and 244 is rotationally driven, the intermediate transfer belt 224 is circularly moved (rotated) in a direction (for example, the counterclockwise direction in FIG. 4) while being in contact with the photoreceptor 232. The winding roller 242 serves as a counter roller facing the second transfer roller 228.

Each of the first transfer rollers 226 faces the photoreceptor 232 with the intermediate transfer belt 224 disposed therebetween. The space between each of the first transfer rollers 226 and the photoreceptor 232 serves as a first transfer position where the toner image formed on the photoreceptor 232 is transferred to the intermediate transfer belt 224.

The second transfer roller 228 faces the winding roller 142 with the intermediate transfer belt 224 disposed therebetween. The space between the second transfer roller 228 and the winding roller 242 serves as a second transfer position where the toner image transferred to the intermediate transfer belt 224 is transferred to the recording medium P.

The transport part 216 includes a feeding roller 246 which feeds the recording medium P housed in the housing part 212, a transport passage 248 through which the recording medium P fed by the feeding roller 246 is transported, and plural transport rollers 250 disposed along the transport passage 248 to transport the recording medium P, fed by the feeding roller 246, to the second transfer position.

In addition, a fixing device 260 is provided on the downstream side of the second transfer position in the transport direction so as to fix the toner image formed on the recording medium P by the image forming part 214 to the recording medium P.

The fixing device 260 includes a heating roller 264 which heats the image on the recording medium P and a pressure roller 266 as an example of a pressure member. In addition, a heating source 264B is provided in the heating roller 264.

Further, a discharge roller 252 is provided on the downstream side of the fixing device 260 in the transport direction so as to discharge the recording medium P with the image fixed thereto to the discharge part 218.

Next, an image forming operation of forming an image on the recording medium P in the image forming apparatus 210 is described.

In the image forming apparatus 210, the recording medium P fed from the housing part 212 by the feeding roller 246 is fed to the second transfer position by the plural transport rollers 250.

On the other hand, in each of the image forming units 222Y to 222K, the photoreceptor 232 charged by the charging device 223 is exposed by the exposure device 236 to form a latent image on the photoreceptor 232. The latent image is developed by the developing device 238 to form a toner image on the photoreceptor 232. The toner images of the colors formed by the respective image forming units 222Y to 222K are superposed on the intermediate transfer belt 224 at the first transfer positions, forming a color image. Then, the color image formed on the intermediate transfer belt 224 is transferred to the recording medium P at the second transfer position.

The recording medium P having the toner image transferred thereto is transported to the fixing device 260, and the transferred toner image is fixed by the fixing device 260. The recording medium P with the toner image fixed thereto is discharged to the discharge part 218 by the discharge roller 152. As described above, a series of image forming operations is performed.

The image forming apparatus 210 according to the exemplary embodiment of the present disclosure is not limited to the configuration described above, and for example, a well-known image forming apparatus such as a direct transfer-system image forming apparatus or the like may be used, in which the toner image formed on each of the photoreceptors 232 of the image forming units 222Y to 222K is directly transferred to the recording medium P.

EXAMPLES

Examples are described below, but the present disclosure is not limited to these examples. In the description below, "parts" and "%" are all on a mass basis unless otherwise specified.

Example 1

(Formation of Elastic Roller)

A mixture described below is kneaded by an open roller to produce a rubber kneaded material A, and the rubber kneaded material A and a nonhollow shaft (made of SUS, diameter: 12 mm) are simultaneously extruded to produce a roller (referred to as a "nonvulcanized rubber roller" hereinafter) having a cylindrical rubber kneaded material A on the outer peripheral surface of the shaft. Next, the cylindrical rubber kneaded material A is vulcanized by heating the nonvulcanized rubber roller at 160° C. for 30 minutes, thereby producing a rubber roller after vulcanization. Next, the rubber after vulcanization is taken out by blowing air into the shaft of the rubber roller after vulcanization and then cut in a length of 224 mm.

Next, a shaft (an example of the substrate, made of SUS, diameter: 12 mm) is inserted in a through hole at a central portion of the rubber after vulcanization, and the outer peripheral surface of the roller is polished to produce an elastic roller (a roller having the elastic layer formed on the outer peripheral surface of the shaft) having an outer diameter of 20.5 mm (elastic layer thickness: 4.25 mm).

—Composition of Mixture—

Rubber material . . . 100 parts by mass (containing nitrile rubber (manufactured by JSR Corporation, trade name: N230SV) and epichlorohydrin rubber (manufactured by Osaka Soda Co., Ltd., trade name: CG102) at a mass ratio of 100/60)

Carbon black (#55: manufactured by Asahi Carbon Co., Ltd.) . . . 15 parts by mass Vulcanization agent (sulfur) 200 mesh: manufactured by Tsurumi Chemical Industry Co., Ltd. . . . 1 part by mass Vulcanization accelerator (Nocceler DM: manufactured by Ouchi Shinko Chemical Industrial Co., Ltd.) . . . 1.5 parts by mass Vulcanization accelerator (Nocceler TET: manufactured by Ouchi Shinko Chemical Industrial Co., Ltd.) . . . 1.0 parts by mass Zinc oxide (zinc flower No. 1: manufactured by Seido Chemical Industry Co., Ltd.) . . . 5 parts by mass Calcium carbonate (Whiton SSB: Shiraishi Calcium K.K.) . . . 10 parts by mass Stearic acid (stearic acid S: manufactured by Kao Corporation) . . . 1 part by mass Antioxidant (Nocrac 300: manufactured by manufactured by Ouchi Shinko Chemical Industrial Co., Ltd., compound name: 4,4'-thiobis(3-methyl-6-tert-butylphenol)) . . . 3 parts by mass Foaming agent A (azodicarbonamide (ADCA)) . . . proper amount Foaming agent B (4,4'-oxybis(benzenesulfonylhydrazide), OBSH) . . . proper amount

Examples 2, 3, 18 to 21, 24, and 25

An elastic roller is produced by the same method as in Example 1 except that the amounts of the foaming agent A and foaming agent B added are changed so that the characteristics of an elastic layer are as described in Table 1.

Examples 4 to 17, 22, and 23, and Comparative Examples 4 to 6

An elastic roller is produced by the same method as in Example 1 except that the heating temperature and heating time of the nonvulcanized rubber roller are changed so that the characteristics of an elastic layer are as described in Table 1.

Comparative Example 1

A mixture having the same composition as that of the rubber kneaded material A described in Example 1 is extrusion-molded in a tube shape an extruder and then foamed by heating under a pressurized steam in a vulcanizer. A metal core is pressed into the vulcanized elastic foam layer, and then the outer diameter of the elastic foam layer is polished. Next, 100 parts of EPDM-based rubber material (NE40 manufactured by JSR Corporation), 12 parts of granular acetylene black (manufactured by Denka Co., Ltd.), and 25 parts (ρv: 7.5) of FT carbon (manufactured by Asahi Carbon Co., Ltd.) are kneaded, and the resultant raw material of an elastic layer is coated on the outside of the elastic foam layer by using a tube crosshead extrusion molding machine.

Therefore, an elastic roller having a multilayer structure is produced.

Comparative Examples 2 and 3

An elastic roller is produced by the same method as in Example 1 except that the amounts of the foaming agent A and foaming agent B added and the heating temperature and heating time of the nonvulcanized rubber roller are changed so that the characteristics of an elastic layer are as described in Table 1.

<Measurement>

With respect to the elastic roller produced in each of the examples, the methods described above are used to measure the elastic modulus of the elastic layer at a distortion of 10%, the ratio (elastic modulus of outer surface portion/elastic modulus of inner surface portion) of the elastic modulus of the outer surface portion to the elastic modulus of the inner surface portion, the difference (MD-1 hardness of inner surface portion—MD-1 hardness of outer surface portion) between the MD-1 hardness of the inner surface portion and the MD-1 hardness of the outer surface portion, specific gravity, and Asker C hardness. The results are shown in Table 1.

<Evaluation>

The elastic roller of each of the examples is attached as a transfer member to an intermediate transfer-system image forming apparatus (manufactured by Fuji Xerox Co., Ltd.) and evaluated as described below.

(Evaluation of Nip Properties)

The elastic roller is attached as a second transfer roller to the image forming apparatus (manufactured by Fuji Xerox Co., Ltd.), and an image is formed on A4 size paper by using the image forming apparatus under the conditions of an ordinary operating environment in which the temperature is kept at 22° C. and the humidity is kept at 55%. Then, the image formed on the paper is qualitatively evaluated by observation with an optical microscope according to the following criteria.

A: No change in image density is observed.

B: A slight change in image density is observed.

C: A change in image density, such as image missing, voids, scattering, or the like, is observed.

(Evaluation of Distortion)

The elastic roller is allowed to stand in an environment at 22° C. and a humidity of 55% for 24 hours. Then, the elastic roller is set on a SUS-made metal plate so that the elastic layer of the elastic roller bites by 0.6 mm into the plate, and then allowed to stand in an environment at 45° C. and a humidity of 95% for 48 hours. After being allowed to stand for 48 hours, the elastic roller is allowed to stand in an environment at 22° C. and a humidity of 55% for 24 hours and then removed from the biting. The elastic roller is provided as a second transfer roller in the image forming apparatus (manufactured by Fuji Xerox Co., Ltd.), and an image is formed on A4 size paper by using the image forming apparatus under the conditions of an ordinary operating environment in which the temperature is kept at 22° C. and the humidity is kept at 55%. Then, the image formed on the paper is qualitatively evaluated by observation with an optical microscope according to the following criteria.

A: No change in image density is observed.

B: A slight change in image density is observed.

C: A change in image density, such as voids or the like, is observed.

TABLE 1

| | | Elastic layer | | | | | Evaluation | |
|---|---|---|---|---|---|---|---|---|
| | Layer structure | Elastic modulus at distortion of 10% (MPa) | Elastic modulus ratio — | MD-1 hardness difference (°) | Specific gravity (g · cm$^3$) | Asker C hardness (°) | Nip property — | Distortion — |
| Example 1 | Single layer | 0.15 | 0.60 | 7.0 | 0.50 | 34 | A | A |
| Example 2 | Single layer | 0.17 | 0.80 | 2.8 | 0.48 | 34 | A | A |
| Example 3 | Single layer | 0.19 | 0.25 | 6.2 | 0.52 | 37 | A | A |
| Example 4 | Single layer | 0.20 | 0.15 | 0.3 | 0.52 | 37 | A | B |
| Example 5 | Single layer | 0.18 | 0.41 | 9.8 | 0.49 | 35 | A | A |
| Example 6 | Single layer | 0.19 | 0.35 | 8.4 | 0.51 | 34 | A | B |
| Example 7 | Single layer | 0.21 | 0.68 | 5.1 | 0.55 | 36 | A | A |
| Example 8 | Single layer | 0.19 | 0.90 | 2.7 | 0.53 | 35 | B | A |
| Example 9 | Single layer | 0.17 | 0.74 | 2.2 | 0.48 | 32 | A | A |
| Example 10 | Single layer | 0.24 | 0.78 | 12.0 | 0.61 | 39 | A | A |
| Example 11 | Single layer | 0.25 | 0.36 | 13.0 | 0.64 | 42 | A | B |
| Example 12 | Single layer | 0.19 | 0.71 | 5.0 | 0.52 | 34 | A | A |
| Example 13 | Single layer | 0.17 | 0.83 | 3.0 | 0.49 | 32 | A | B |
| Example 14 | Single layer | 0.22 | 0.50 | 9.5 | 0.59 | 38 | A | A |
| Example 15 | Single layer | 0.24 | 0.41 | 12.0 | 0.63 | 41 | B | A |
| Example 16 | Single layer | 0.15 | 0.65 | 4.5 | 0.32 | 25 | A | A |
| Example 17 | Single layer | 0.16 | 0.60 | 2.9 | 0.28 | 20 | A | B |
| Example 18 | Single layer | 0.16 | 0.75 | 3.3 | 0.38 | 25 | A | A |
| Example 19 | Single layer | 0.15 | 0.65 | 2.2 | 0.37 | 24 | A | B |
| Example 20 | Single layer | 0.25 | 0.79 | 4.5 | 0.65 | 45 | A | A |
| Example 21 | Single layer | 0.27 | 0.73 | 6.1 | 0.61 | 46 | B | A |
| Example 22 | Single layer | 0.20 | 0.88 | 2.3 | 0.54 | 40 | A | A |
| Example 23 | Single layer | 0.17 | 0.33 | 11.0 | 0.46 | 32 | A | A |
| Example 24 | Single layer | 0.22 | 0.80 | 1.5 | 0.58 | 38 | A | A |
| Example 25 | Single layer | 0.19 | 0.34 | 13.0 | 0.53 | 35 | A | A |
| Comparative Example 1 | Multilayer | 0.30 | 0.57 | 8.0 | 0.80 | 37 | C | B |
| Comparative Example 2 | Single layer | 0.12 | 0.65 | 5.3 | 0.30 | 22 | A | C |
| Comparative Example 3 | Single layer | 0.19 | 1.00 | 1.7 | 0.61 | 34 | C | A |
| Comparative Example 4 | Single layer | 0.17 | 0.89 | 1.8 | 0.47 | 30 | A | C |
| Comparative Example 5 | Single layer | 0.27 | 0.97 | 0.5 | 0.75 | 42 | A | C |
| Comparative Example 6 | Single layer | 0.32 | 0.95 | 1.0 | 0.90 | 47 | C | A |

The results described above indicate that the elastic members of the examples suppress a change in image density, and thus can form a nearly uniform nip with the pressing target member and suppress distortion of the elastic layer possessed by the elastic member after the elastic member is maintained in a state of being pressed against the pressing target member.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An elastic member comprising:

a substrate; and an clastic elastic layer provided on the substrate, wherein an elastic modulus of the elastic layer at a distortion of 10% is 0.15 MPa or more; and a thickness of the elastic layer is t, and when in the elastic layer, a region from a surface on a side opposite to the substrate to a position at a depth of t/2.125 is referred to as an outer surface potion, and a region from a substrate-side surface to a position at a depth of t/2.125 is referred to as an inner surface portion, a ratio of an elastic modulus of the outer surface portion to an elastic modulus of the inner surface portion is 0.8 or less.

2. The elastic member according to claim 1, wherein the ratio of the elastic modulus of the outer surface portion to the elastic modulus of the inner surface portion is 0.2 or more and 0.8 or less.

3. The elastic member according to claim 2, wherein the ratio of the elastic modulus of the outer surface portion to the elastic modulus of the inner surface portion is 0.4 or more and 0.7 or less.

4. The elastic member according to claim 3, wherein a difference between the MD-1 hardness of the inner surface portion and the MD-1 hardness of the outer surface portion is 2° or more and 12° or less.

5. The elastic member according to claim 4, wherein the difference between the MD-1 hardness of the inner surface portion and the MD-1 hardness of the outer surface portion is 2° or more and 12° or less.

6. The elastic member according to claim 4, wherein a specific gravity of the elastic layer is 0.3 g/cm$^3$ or more and 0.8 g/cm$^3$ or less.

7. The elastic member according to claim 3, wherein a specific gravity of the elastic layer is 0.3 g/cm$^3$ or more and 0.8 g/cm$^3$ or less.

8. The elastic member according to claim 2, wherein a difference between the MD-1 hardness of the inner surface portion and the MD-1 hardness of the outer surface portion is 2° or more and 12° or less.

9. The elastic member according to claim 8, wherein the difference between the MD-1 hardness of the inner surface portion and the MD-1 hardness of the outer surface portion is 2° or more and 12° or less.

10. The elastic member according to claim 8, wherein a specific gravity of the elastic layer is 0.3 g/cm$^3$ or more and 0.8 g/cm$^3$ or less.

11. The elastic member according to claim 2, wherein a specific gravity of the elastic layer is 0.3 g/cm$^3$ or more and 0.8 g/cm$^3$ or less.

12. The elastic member according to claim 1, wherein a difference between the MD-1 hardness of the inner surface portion and the MD-1 hardness of the outer surface portion is 2° or more and 12° or less.

13. The elastic member according to claim 12, wherein the difference between the MD-1 hardness of the inner surface portion and the MD-1 hardness of the outer surface portion is 4° or more and 10° or less.

14. The elastic member according to claim 12, wherein a specific gravity of the elastic layer is 0.3 g/cm$^3$ or more and 0.8 g/cm$^3$ or less.

15. The elastic member according to claim 1, wherein a specific gravity of the elastic layer is 0.3 g/cm$^3$ or more and 0.8 g/cm$^3$ or less.

16. The elastic member according to claim 1, wherein an Asker C hardness measured from the surface of the elastic layer on the side opposite to the substrate is 25° or more and 45° or less.

17. A transfer device comprising the elastic member according to claim 1 as a transfer member that transfers a transferred material to a transfer target.

18. A process cartridge detachable from an image forming apparatus, comprising the transfer device according to claim 17.

19. An image forming apparatus comprising:

an image holding member;

a charging device that charges the surface of the image holding member;

an electrostatic latent image forming device that forms an electrostatic latent image on the charged surface of the image holding member;

a developing device that forms a toner image by developing the electrostatic latent image formed on the surface of the image holding member with a developer containing a toner; and the transfer device according to claim 17 that transfers the toner image to the surface of a recording medium.

20. An elastic member comprising:

a substrate; and an elastic layer provided on the substrate, wherein an elastic modulus of the elastic layer at a distortion of 10% is 0.15 MPa or more; and a thickness of the elastic layer is t, and when in the elastic layer, a region from a surface on a side opposite to the substrate to a position at a depth of t/2.125 is referred to as an outer surface portion, and a region from a substrate-side surface to the position at a depth of t/2.125 is referred to as an inner surface portion, a difference between the MD-1 hardness of the inner surface portion and the MD-1 hardness of the outer surface portion is 2° or more and 12° or less.

* * * * *